US007070704B2

(12) United States Patent
Kang et al.

(10) Patent No.: US 7,070,704 B2
(45) Date of Patent: Jul. 4, 2006

(54) COMPOSITION OF ENVIRONMENTAL FRIENDLY NEUTER LOADED STREAM EXTINGUISHER FOR ORDINARY FIRE (A CLASS) AND METHOD FOR PREPARING THE SAME

(75) Inventors: Jung Kang, Seoul (KR); Doo-Whan Kang, Inchon (KR); Chang-Woo Lee, Uijeongbu (KR); Jae-Dong Jung, Seoul (KR)

(73) Assignee: Fire & Tech Co., Ltd., Anyang (KR)

( * ) Notice: Subject to any disclaimer, the term of this patent is extended or adjusted under 35 U.S.C. 154(b) by 0 days.

(21) Appl. No.: 10/502,202

(22) PCT Filed: Jan. 16, 2003

(86) PCT No.: PCT/KR03/00094

§ 371 (c)(1),
(2), (4) Date: Feb. 3, 2005

(87) PCT Pub. No.: WO03/059456

PCT Pub. Date: Jul. 24, 2003

(65) Prior Publication Data

US 2005/0116193 A1 Jun. 2, 2005

(30) Foreign Application Priority Data

Jan. 18, 2002 (KR) ..... 2002-3054

(51) Int. Cl.

| | |
|---|---|
| ***A62D 1/00*** | (2006.01) |
| ***A62D 1/02*** | (2006.01) |
| ***A62D 1/03*** | (2006.01) |
| ***A62C 3/00*** | (2006.01) |

(52) U.S. Cl. ..... 252/2; 252/4; 252/7; 169/46; 169/47

(58) Field of Classification Search ..... 252/2
See application file for complete search history.

(56) References Cited

U.S. PATENT DOCUMENTS

| | | | | |
|---|---|---|---|---|
| 3,214,372 | A * | 10/1965 | Lobos | 252/7 |
| 3,238,129 | A * | 3/1966 | Veltman | 252/7 |
| 4,804,482 | A | 2/1989 | Schuler | 252/7 |
| 4,971,728 | A | 11/1990 | Vandersall | 252/603 |
| 5,091,097 | A * | 2/1992 | Pennartz | 252/7 |
| 5,489,399 | A * | 2/1996 | Koyakumaru et al. | 252/373 |
| 5,510,041 | A * | 4/1996 | Sonnino | 252/3 |
| 5,585,028 | A * | 12/1996 | Berger | 252/2 |
| 5,651,416 | A | 7/1997 | Clauson et al. | 169/46 |
| 5,909,776 | A | 6/1999 | Stewart et al. | 169/26 |
| 2004/0089456 | A1 * | 5/2004 | Howorka | 169/5 |

FOREIGN PATENT DOCUMENTS

| | | |
|---|---|---|
| KR | 0003481 | 3/1997 |
| KR | 94008164 | 3/1997 |
| KR | 259512 B1 | 3/2000 |
| KR | 0074282 | 8/2001 |

* cited by examiner

*Primary Examiner*—Joseph D. Anthony
(74) *Attorney, Agent, or Firm*—Abelman, Frayne & Schwab

(57) ABSTRACT

Disclosed is an environment-friendly, pH-neutral, loaded stream extinguishant and a method for preparing the same. The extinguishant is prepared from a mixture of a fire extinguishable component, an organic acid, a surfactant and water. It is very effective in controlling A class fires, as well as showing excellent flame retardance. Also, the extinguishant is neutral in pH so as to neither corrode extinguisher parts, nor affect soil negatively. It can be also applied to portable extinguishers.

8 Claims, No Drawings

COMPOSITION OF ENVIRONMENTAL FRIENDLY NEUTER LOADED STREAM EXTINGUISHER FOR ORDINARY FIRE (A CLASS) AND METHOD FOR PREPARING THE SAME

TECHNICAL FIELD

The present invention relates to the composition of a neuter loaded stream extinguishant. More particularly, the present invention pertains to the composition of a neuter loaded stream extinguishant, which is environmental-friendly and very effective in controlling ordinary fires. Also, the present invention is concerned with a method for preparing such a neuter loaded stream extinguishant.

BACKGROUND ART

Usually, water or powder form of fire extinguishing agents has been employed to quench ordinary fires. Water, however, which has high freezing point, 0° C., is difficult to use in cold places or outdoors in the winter season. The powder form of fire-extinguishing agents may cause significant secondary damages after the extinction of flames, and they should be rocked or swung at least once every six months lest they will solidify during storage. In addition, the powder agents are difficult to store in humid places. For controlling forest fires, which is an A class fire, foam phase fire extinguishing agents are being used, but they do not show desired performance. For these situations, there has been extensive research to develop new powerful neuter loaded stream fire extinguishing agents. On the whole, the extinguishing power of loaded stream fire extinguishing agents are known to efficient in controlling oil fires, a B class fire; however, they are insufficient for controlling an A class fire, such as a forest fire. For these reasons, development of a neuter loaded stream fire extinguishing agents, which have not only an excellent efficiency in fire control but also environmentally friendly, is in high demand.

Some advanced country, like U.S or Japan, has come into, marketing neuter loaded stream extinguishants for controlling B class fires, which are nontoxic nor harmless to the human body and cause no corrosion to various metal, became they have legal stipulations requiring the use of a neuter loaded stream extinguishers only. However, neuter loaded stream extinguisher with highly effective in controlling A class fires, non corrosive to metal, and friendly to environments have not developed.

Alkaline aqueous solution of loaded stream extinguishers may cause secondary problems: harmful to human body and corrosive to particular parts of automatic fire extinguishers. Although they have a strong extinguishing power, the loaded stream extinguishants with high alkalinity cannot be put on the market. While demand for neuter loaded stream extinguishers will drastically increase all over the world, legal regulations for corrosion prevention and safety for human body will be reinforced and stringent.

Fire extinguishers are introduced in many patents. For example, U.S. Pat. No. 5,909,776 discloses a fire extinguisher containing a gel-type, fire-extinguishing composition comprising a gas selected from the group consisting of a perfluorocarbon, a hydrochlorofluorocarbon, and a hydrofluorocarbon, into which particles of dry powder fire-extinguishing agent having average particle sizes of 500 microns are dispersed, along with a surfactant and a deflocculant stabilizer.

U.S. Pat. No. 5,651,416 describes a fire extinguishing method, which uses an extinguisher comprising an alkaline metal salt or an ammonium salt of acetate, chloride or bromide, a freezing point suppressant, a surfactant, and water.

Korean Pat. Registration Publication No. 93-3391 discloses a fire extinguishing composition comprising a $C_1$–$C_5$ halogenoalkane selected from the group consisting of bromochlorodifluoromethane, bromotrifluoromethane, dibromofluoromethane and mixtures thereof, and an organic phosphorous compound selected from the group consisting of trialkylphosphate, triarylphosphate, and trihalogenoalkylphosphate.

Korean Pat. Registration Publication No. 97-9308 disclosed a fire extinguishing composition comprising an extract from a plant selected from among sapindaceae, cruciferae, leguminosae, ulnaceae, and combinations thereof, and a surfactant such as dodecyl polyetheneoxy sodium sulfate or sodium dodecyl aminopropionate.

Methods of preparing liquid extinguishants are also disclosed in Korean Pat. No. 117936. Urea, trisodium phosphate, ammonium bicarbonate and sodium carbonate are dissolved, in order, in aqueous solution of ammonium sulfate to produce a liquid extinguishant. A method suggested by Korean Pat. No. 259512 comprises dissolving trisodium phosphate, ammonium sulfate, and urea, in order, in aqueous solution of soda ash. In Korean Pat. No. 112862, an extinguisher is prepared from a mixture of an aqueous solution of ammonium bicarbonate and sodium phosphate, an aqueous solution of urea, ammonium sulfate, and sodium carbonate, and an aqueous solution containing calcium chloride in liquid aluminum sulfate.

The conventional fire extinguishing agents as above mentioned have poor extinguishing power to control A class fires, such as forest fires, and have insufficient flame retardant. Further, the said fire extinguishing agents cause secondary damages: toxicity to human bodies, contamination of soil, and corrosion of extinguisher parts, which are attributable to the alkalinity thereof.

Thus, there remains a need for an improved neuter extinguishing system that has an excellent in extinguishing power to quench A class fires, as well as environmentally friendly.

DISCLOSURE OF THE INVENTION

It is an object of the present invention to solve problems encountered in prior arts and to provide the composition of a neuter fire extinguisher, which has a sufficient extinguishing power to put out ordinary fires, A class fires, without causing harmful effects to the human body and corroding extinguisher parts. The invention can be applied to portable extinguishers, without contamination of soil.

It is another object of the present invention to provide a method for preparing the fire extinguisher as above.

In accordance with one aspect of the present invention, provided is a neuter loaded stream extinguisher for use in controlling ordinary fires, comprising 10–50% by weight of a fire extinguishable component, 3–15% by weight of an organic acid, 0.01–5% by weight of surfactant, according to water based on 100% by weight, which has an environmental friendly and shows an excellent fire extinguishing power and flame retardant.

In another aspect of the present invention, there is provided a method for preparing a neuter loaded stream extinguishant for use in controlling ordinary fires, comprising the steps of:

dissolving 10–50% by weight of a fire extinguishable component in water;

dissolving 3–15% by weight of an organic acid followed by 0.01–5% by weight of a surfactant, in the said solution; and allowing the solution to stand at room temperature for 24–48 hours so as to stabilize the solution.

BEST MODES FOR CARRYING OUT THE INVENTION

For use in controlling ordinary fires, a fire extinguishant which has excellent fire-extinguishing and flame retardant properties and friendly to the environment is prepared from a composition comprising a fire-extinguishable component, an organic acid, a surfactant, and water, in accordance with the present invention.

When in contacting with flames or seating of fire, the useful fire extinguishable component in the present invention is responsible for the function of killing flames or controlling seat of fire rather than being combusted. The fire extinguishable component may be one or more inorganic compound selected from the group consisting of ammonium sulfate [$(NH_4)_2SO_4$], urea [$(NH_2)_2CO$], trisodium phosphate [$Na_3PO_4 \cdot 12H_2O$], ammonium hydrogen carbonate [$NH_4HCO_3$], sodium carbonate [$Na_2CO_3$], ammonium phosphate [$(NH_4)_3PO_4$], potassium sulfate [$K_2SO_4$], potassium carbonate [$K_2CO_3$] and mixtures thereof. The fire extinguishable component is used in an amount of 10–50% by weight based on the fire extinguishant. When the content of the fire extinguishable component is below 10% by weight, the fire extinguishant shows poor fire extinguishing power and flame retardant property. On the other hand, more than 50% by weight of the fire extinguishable component causes the formation of precipitates in the composition.

With the aim of establishing the neuter fire extinguishant, the organic acid is selected from the group consisting of citric acid, malonic acid, maleic acid, gluconic acid, tannic acid, oxalic acid, adipic acid, salicylic acid, and mixtures thereof. The organic acid is used in an amount of 3–15% by weight based on the fire extinguishant. When the amount of the organic acid is outside of 3–15% by weight range, the pH of the final fire extinguishant cannot reach neutrality.

Useful in the present invention is a water-soluble surfactant, which may be anionic, cationic or non-ionic and is specifically selected from the group consisting of lauryl dimethylamine oxide, sodium lauryl sulfate, cetyl trimethyl ammonium chloride and laurarnide DEA. Preferable is amine oxide, which is commercially available from Miwon Co. Sold as "Minox L". With a surface tension reduced to 33 dyne/cm or less by the surfactant, the fire extinguishing composition can readily penetrate the fire seat of a material being burnt, thereby effectively controlling deep-seated fire. In the fire extinguishant of the present invention, the surfactant is present in an amount of 0.01–5% by weight based on the fire extinguishant. Less than 0.01% by weight of the surfactant results in the surface tension of the fire extinguishant not being reduced to a desired value. On the other hand, if the surfactant is too abundant, a part of the surfactant remains undissolved and floating.

Water added in a balanced amount functions as a solvent to dissolve and retain the above components. Tap water or subterranean water may be used without purification.

The preparation of the fire extinguishant of the present invention starts with the dissolution of 10–50% by weight of a fire extinguishable component in water. An organic acid is dissolved to said solution in an amount of 3–15% by weight, followed by dissolving a surfactant in an amount of 0.01–5% by weight. For stabilization, the resulting solution is allowed to stand for 24–48 hours at room temperature. The neuter loaded stream extinguishant as obtained in the above procedure is friendly to environment and neutral, as well as superior in extinguishing power and. having fire retardant, and property.

In the early stage of the dissolution of the organic acid, there may be foam generated, but the finally obtained extinguishant does not form bubbles or foam, so that it can fill an extinguisher without any problem in handling.

The neuter loaded stream extinguishant prepared according to the present invention is effective in controlling A class fires. Also, with a neutrality in pH, the loaded stream extinguishant does not damage human bodies nor corrode extinguisher parts, nor it a has negative effect on soil. Additionally, the loaded stream extinguishant is applied to portable extinguishers, which can be manually operated. Over the conventional ones, the loaded stream extinguishant of the present invention is far superior in terms of flame retardant, and provides a substances such as paper, paint, etc. with flame retardant. Therefore, the neuter loaded stream extinguishant of the present invention has advantages in that it may be utilized in extinguishers for controlling fires as well as various products requiring flame retardant, at construction and flooring materials.

What is more, the neuter loaded stream extinguishant of the present invention can be prepared from inexpensive industrial materials, thus produced at low cost. Furthermore, the neuter loaded stream extinguishant of the present invention has the advantage of high quality and low cost, when compared to the conventional extinguishants. Its production is simple and can be accomplished at a short of time. The use of tap or subterranean water, as well as purified water, adds an advantage to the convenience of the loaded stream extinguishant of the present invention.

A better understanding of the present invention may be obtained in light of the following Examples which are set forth to illustrate, but are not to be construed to limit the present invention.

EXAMPLE 1

To 100 g of water were dissolved 50 g of ammonium sulfate and 10 g of sodium carbonate. Then, 8 g of citric acid and 2 g of amine oxide were added thereto and dissolved, in order, followed by allowing the resulting solution to stand for 24 hours to give a neuter loaded stream extinguishant.

EXAMPLE 2

To 100 g of water were dissolved 70 g of ammonium sulfate and 5 g of urea. Then, 8 g of citric acid and 2 g of amine oxide were added thereto and dissolved, in order.

Thereafter, the resulting solution Was allowed to stand for 24 hours in order to give a loaded stream extinguishant.

EXAMPLE 3

To 100 g of water were dissolved 10 g of urea, 10 g of trisodium phosphate, 10 g of ammonium hydrogen carbonate and 40 g of sodium carbonate all at once. Then, 30 g of citric acid and 4 g of amine oxide was added thereto and dissolved. Thereafter, the resulting solution was allowed to stand for 24 hours in order to give a loaded stream extinguishant.

EXAMPLE 4

To 100 g of water were dissolved 65 g of ammonium sulfate, 9 g of trisodium phosphate, 9 g of ammonium hydrogen carbonate, and 9 g of sodium carbonate all at once. Then, 7 g of citric acid and 1 g of maleic acid was added thereto and dissolved. Thereafter, the resulting solution was allowed to stand for 24 hours in order to afford a loaded stream extinguishant.

The loaded stream extinguishants obtained in Examples (No.) 1 to 4 were measured for their physical properties according to official standards, as follows:

1. When an extinguisher is operated under normal conditions, the neuter loaded stream extinguishant released should be flame resistant and have a freezing point of −20° C. or lower. Following is a procedure of determining the freezing point. First, 10 ml of a sample is placed in a test tube with an inner diameter of 18 mm, along with a thermometer, and cooled in a cryogenic bath while being stirred with the stirrer in order to prevent overcooling. Once precipitates being formed, the test tube is removed from the cryogenic bath. When the liquid becomes clear while the stirring continues, the temperature is read. The freezing point is a mean value of the results of 3 times measurements obtained frame same procedure.

2. The surface tension of a loaded stream extinguishant is measured according to the Du Nouy method after the liquid is maintained at 20±0.5° C. The surface tension measured was 33 dyne/cm or lower.

3. Specific gravity is measured with the aid of a specific gravity hydrometer or a specific gravity bottle according to a standard for chemical products.

4. pH is measured 20±0.5° C.

5. Precipitation is quantified according to a test method for measuring the precipitation number of lubricant, by use of a neuter loaded stream extinguishant maintained at 20±2° C. without an addition of precipitating naphtha. In this regard, the loaded stream extinguishant should be used in an amount of 0.1 vol. % or less.

6. Corrosiveness is determined by the weight loss of a metal substance such as steel, brass and aluminum, which has been immersed in a loaded stream extinguishant at 38±2° C. for 21 days. A desired extinguishant must cause a loss of the weight of the metal substance at a rate of 3 mg/20 $cm^2$/day or less.

The physical properties of the extinguishants obtained in Examples 1 to 4, measured according to the above description, are summarized along with other physical properties including appearance, toxicity and odor, in Table 1, below. For comparison, the same physical properties of a commercially available extinguishant are also described in Table 1.

TABLE 1

| Property | Example 1 | Example 2 | Example 3 | Example 4 | C. Exmp. |
|---|---|---|---|---|---|
| Appearance | Pale brown | Pale brown | Colorless & clear | Pale brown | Colorless & clear |
| Toxicity | Harmless | Harmless | Harmless | Harmless | Harmles |
| Precipitation | None | None | None | None | None |
| Odor | Slightly | Slightly | Slightly | Slightly | None |
| pH (20° C.) | 7.5 ± 0.5 | 7.0 ± 0.5 | 7.5 ± 0.5 | 7.5 ± 0.5 | 11.0 ± 0.5 |
| Specific Gravity (20° C.) | 1.15 | 1.16 | 1.24 | 1.26 | 1.12 |
| Surface Tension (20° C.) | 27 dyne/cm | 27 dyne/cm | 27 dyne/cm | 27 dyne/cm | 29 dyne/cm |
| Freezing Point | ≦−20° C. | ≦−20° C. | ≦−25° C. | ≦−25° C. | ≦−20° C. |

As apparent from the data of Table 1, the loaded stream extinguishant of the present invention satisfies the official requirements and is very similar to water in terms of pH and specific gravity (1.15–1.26).

Because corrosion may occur in a gas phase and at the boundary between gas and liquid phases, as well as in a liquid phase, evaluation was conducted for all of the phases, and the results are given in Table 2, below.

TABLE 2

| | | Substrate | | | | | | |
|---|---|---|---|---|---|---|---|---|
| Exmp. No. | Phase | Copper | Brass | Steel | Al | Rubber | Stainless Steel | Plastic |
| C. Exmp. | Gas | ○ | ○ | ◎ | ◎ | ◎ | ◎ | ◎ |
| | G-L | ○ | ○ | Δ | X | ◎ | ◎ | ◎ |
| | Liquid | ○ | ◎ | X | X | ◎ | ◎ | ◎ |

TABLE 2-continued

| Exmp. No. | Phase | Substrate | | | | | | |
|---|---|---|---|---|---|---|---|---|
| | | Copper | Brass | Steel | Al | Rubber | Stainless Steel | Plastic |
| 1 | Gas | ○ | ◎ | ◎ | ◎ | ◎ | ◎ | ◎ |
| | G-L | Δ | ◎ | ◎ | ◎ | ◎ | ◎ | ◎ |
| | Liquid | ◎ | ◎ | ◎ | ◎ | ◎ | ◎ | ◎ |
| 2 | Gas | ○ | ◎ | ◎ | ◎ | ◎ | ◎ | ◎ |
| | G-L | Δ | ◎ | ◎ | ◎ | ◎ | ◎ | ◎ |
| | Liquid | ◎ | ◎ | ◎ | ◎ | ◎ | ◎ | ◎ |
| 3 | Gas | ○ | ○ | ◎ | ◎ | ◎ | ◎ | ◎ |
| | G-L | Δ | ○ | ◎ | ◎ | ◎ | ◎ | ◎ |
| | Liquid | ◎ | ◎ | ◎ | ◎ | ◎ | ◎ | ◎ |
| 4 | Gas | ○ | ◎ | ◎ | ◎ | ◎ | ◎ | ◎ |
| | G-L | Δ | ◎ | ◎ | ◎ | ◎ | ◎ | ◎ |
| | Liquid | ◎ | ◎ | ◎ | ◎ | ◎ | ◎ | ◎ |

Note:
◎ not corroded,
○ slightly corroded,
Δ moderately corroded,
X significantly corroded As seen, the extinguishant of the present invention is far less corrosive, in comparison with the conventional extinguishant, to various substances. The conventional extinguishant of high alkalinity was found to seriously corrode steel and brass, whereas the extinguishant of the present invention is so neutral in pH as to be compatible with most substances.

Example for Measurement of Frame Retardantk

One application of the extinguishants prepared in Examples 1 to 4 was applied to paper and wooden board, respectively which were then dried and ignited. The flames did not further advance on the paper and wooden board, but were subdued immediately, which demonstrates that the extinguishant of the present invention is of excellent flame retardance.

Example for Measurement of Extinguishing Power 114 pine and alder tree pieces, each 3 cm in width, 3 cm in thickness and 0.9 m in length, were stacked in a matrix form to a height of 1.5 m. Oil was splashed over the wood stack, which was then ignited. When the flame reached a high point, each of the extinguishants prepared in Examples 1 to 4 was used to kill the flame. In all experiments, fires were completely extinguished within 1 min. The amount of the extinguishants used to kill the seat of-fire was as small as 3 liters.

The results of these experiments show that the extinguishants of the present invention kill fires with much higher efficiency than does water. In the case that oxygen is supplied without limitation, as in open fields, other powder or gas type fire extinguishants are not only difficult to apply to flames, but also have difficulty in obtaining the oxygen dilution effect. In some cases, no extinguishing effects on open field fires are obtained with the conventional extinguishants.

INDUSTRIAL APPLICATION

The loaded stream extinguishant of the present invention, as described hereinbefore, is very effective in controlling A class fires, as well as showing excellent flame retardance. Additionally, the extinguishant is neutral in pH so as to neither corrode extinguisher parts, nor affect soil negatively. It can be also applied to portable extinguishers.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

The invention claimed is:

1. A loaded stream extinguishant for use in controlling general fires, comprising:

(a) 10–50% by weight of a fire extinguishable component comprising (i) ammonium sulfate, and (ii) one or more inorganic compound selected from the group consisting of urea, trisodium phosphate, ammonium hydrogen carbonate, sodium carbonate, ammonium phosphate, potassium sulfate and potassium carbonate;

(b) 3–15% by weight of an organic acid;

(c) 0.0 1–5% by weight of surfactant; and (d) water in a balanced amount to 100% by weight.

2. The loaded stream extinguishant as set forth in claim 1, wherein the organic acid is selected from the group consisting of citric acid, malonic acid, maleic acid, gluconic acid, tannic acid, oxalic acid, adipic acid, salicylic acid and mixtures thereof.

3. The loaded stream extinguishant as set forth in claim 1, wherein the surfactant is water-soluble and selected from the group consisting of a cationic surfactant, an anionic surfactant and a non-ionic surfactant.

4. The loaded stream extinguishant as set forth in claim 3, wherein the surfactant is selected from the group consisting of lauryl dimethylamine oxide, sodium lauryl sulfate, cetyl trimethyl ammonium chloride and lauramide DEA.

5. A method for preparing a loaded stream extinguishant for use in controlling general fires, comprising the steps of:

(a) dissolving 10–50% by weight of a fire extinguishable component comprising ammonium sulfate, and one or more inorganic compound selected from the group consisting of urea, trisodium phosphate, ammonium hydrogen carbonate, sodium carbonate, ammonium phosphate, potassium sulfate and potassium carbonate, in water;

(b) dissolving 3–15% by weight of an organic acid followed by 0.0 1–5% by weight of a surfactant, in the solution; and (c) allowing the solution to stand at room temperature for 23–38 hours so as to stabilize the solution.

6. The method as set forth in claim 5, wherein the organic acid is selected from the group consisting of citric acid, malonic acid, maleic acid, gluconic acid, tannic acid, oxalic acid, adipic acid, salicylic acid and mixtures thereof.

7. The method as set forth in claim 5, wherein the surfactant is water-soluble and selected from the group consisting of a cationic surfactant, an anionic surfactant and a non-ionic surfactant.

8. The method as set forth in claim 5, wherein the surfactant is selected from the group consisting of lauryl dimethylamine oxide, sodium lauryl sulfate, cetyl trimethyl ammonium chloride and lauramide DEA.

* * * * *